US008533986B2

(12) United States Patent
Klotz

(10) Patent No.: US 8,533,986 B2
(45) Date of Patent: Sep. 17, 2013

(54) BOLT FOR A REPEATING FIREARM

(75) Inventor: Matthias Klotz, Gestratz (DE)

(73) Assignee: Blaser Finanzholding Gmb, Isny (DE)

( * ) Notice: Subject to any disclaimer, the term of this patent is extended or adjusted under 35 U.S.C. 154(b) by 28 days.

(21) Appl. No.: 13/302,685

(22) Filed: Nov. 22, 2011

(65) Prior Publication Data

US 2012/0137557 A1 Jun. 7, 2012

(30) Foreign Application Priority Data

Nov. 25, 2010 (DE) ..... 10 2010 052 536

(51) Int. Cl.
*F41A 3/00* (2006.01)

(52) U.S. Cl.
USPC ..... 42/16; 89/1.4

(58) Field of Classification Search
USPC ..... 42/16; 89/1.4
See application file for complete search history.

(56) References Cited

U.S. PATENT DOCUMENTS

| | | | | | |
|---|---|---|---|---|---|
| 85,162 | A | * | 12/1868 | Berdan | 42/16 |
| 157,783 | A | * | 12/1874 | Berdan | 42/16 |
| 206,279 | A | * | 7/1878 | Trabue | 42/21 |
| 557,079 | A | * | 3/1896 | Mondragon | 42/16 |
| 760,871 | A | * | 5/1904 | Johnson | 89/168 |
| 835,679 | A | * | 11/1906 | Hansen | 42/16 |
| 853,438 | A | * | 5/1907 | Browning | 42/16 |
| 1,057,329 | A | * | 3/1913 | Clarus | 89/154 |
| 1,349,675 | A | * | 8/1920 | Johnson | 42/16 |
| 1,568,635 | A | * | 1/1926 | Speer | 42/16 |
| 1,707,538 | A | * | 4/1929 | Page | 42/16 |
| 2,072,197 | A | * | 3/1937 | Bergmann | 89/197 |
| 2,085,812 | A | | 7/1937 | Loomis | |
| 2,098,137 | A | * | 11/1937 | Elfstrom | 42/16 |
| 2,181,131 | A | * | 11/1939 | Johnson, Jr. | 42/25 |
| 2,337,150 | A | * | 12/1943 | Burton | 89/194 |
| 2,338,682 | A | * | 1/1944 | Bohan | 89/21 |
| 2,387,413 | A | * | 10/1945 | Shaffnit | 42/16 |
| 2,685,754 | A | * | 8/1954 | Crittendon et al. | 42/16 |
| 2,848,831 | A | * | 8/1958 | McLaughlin | 42/16 |
| 2,882,634 | A | * | 4/1959 | Smith | 42/16 |
| 3,044,361 | A | * | 7/1962 | Lizza | 89/1.4 |
| 3,198,076 | A | * | 8/1965 | Stoner | 89/128 |
| 3,255,667 | A | * | 6/1966 | Walther | 89/1.4 |
| 3,257,749 | A | * | 6/1966 | Donaldson | 42/16 |
| 3,387,400 | A | * | 6/1968 | Badali et al. | 42/70.01 |
| 3,432,955 | A | * | 3/1969 | Vartanian et al. | 42/16 |
| 3,456,375 | A | * | 7/1969 | Kulikowski et al. | 42/16 |
| 3,711,983 | A | * | 1/1973 | Allyn | 42/75.03 |
| 3,755,947 | A | * | 9/1973 | Koon, Jr. | 42/16 |
| 3,782,022 | A | * | 1/1974 | Bielfeldt et al. | 42/70.01 |
| 3,969,980 | A | * | 7/1976 | Brandstatter et al. | 89/33.02 |

(Continued)

FOREIGN PATENT DOCUMENTS

| | | | |
|---|---|---|---|
| DE | 3128369 | A1 | 2/1983 |
| DE | 10055578 | A1 | 5/2001 |

*Primary Examiner* — Michelle Clement
(74) *Attorney, Agent, or Firm* — Fleit Gibbons Gutman Bongini & Bianco PL; Martin Fleit; Paul D. Bianco

(57) ABSTRACT

The invention pertains to a bolt for a repeating firearm having a cylindrical bolt body and a bolt shaft that is detachably fastened on the bolt body. The bolt shaft is screwed to the bolt body by a fastening screw that protrudes into a sleeve-shaped rear section of the bolt body from the inner side of the bolt body through a radial through-opening and engages into a threaded bore of the bolt shaft.

16 Claims, 1 Drawing Sheet

(56) References Cited

U.S. PATENT DOCUMENTS

| | | | | | |
|---|---|---|---|---|---|
| 4,015,357 | A | * | 4/1977 | Andersson | 42/16 |
| 4,020,577 | A | * | 5/1977 | Duffy | 42/16 |
| 4,052,926 | A | * | 10/1977 | Tollinger | 89/1.4 |
| 4,421,006 | A | * | 12/1983 | Kocher et al. | 89/1.4 |
| 4,454,672 | A | | 6/1984 | Timari | |
| 4,547,988 | A | * | 10/1985 | Nilsson | 42/16 |
| 4,672,762 | A | * | 6/1987 | Nilsson | 42/70.01 |
| 5,214,233 | A | * | 5/1993 | Weldle et al. | 89/1.4 |
| 5,440,963 | A | * | 8/1995 | Szecsei | 89/1.41 |
| 5,718,073 | A | * | 2/1998 | Sachse et al. | 42/51 |
| 5,722,194 | A | * | 3/1998 | Wurger et al. | 42/69.02 |
| 5,821,445 | A | * | 10/1998 | Guhring | 89/1.42 |
| 5,900,577 | A | * | 5/1999 | Robinson et al. | 89/191.01 |
| 5,926,988 | A | * | 7/1999 | Casull | 42/25 |
| 6,360,467 | B1 | * | 3/2002 | Knight | 42/51 |
| 6,401,378 | B1 | * | 6/2002 | Ockenfuss | 42/70.01 |
| 6,481,135 | B2 | * | 11/2002 | Zeh et al. | 42/16 |
| 6,508,025 | B1 | * | 1/2003 | Du Plessis | 42/16 |
| 6,782,791 | B2 | * | 8/2004 | Moore | 89/1.4 |
| 7,000,345 | B1 | * | 2/2006 | Kay | 42/75.02 |
| 7,155,856 | B1 | * | 1/2007 | Hylenski | 42/70.08 |
| 8,176,827 | B2 | * | 5/2012 | Emde | 89/1.4 |
| 2007/0006720 | A1 | * | 1/2007 | Liao | 89/1.4 |
| 2008/0083319 | A1 | * | 4/2008 | Richeson | 89/1.4 |
| 2011/0036232 | A1 | * | 2/2011 | Dublin | 89/1.4 |
| 2011/0061523 | A1 | * | 3/2011 | Webb | 89/128 |
| 2012/0073177 | A1 | * | 3/2012 | Laney et al. | 42/16 |

* cited by examiner

BOLT FOR A REPEATING FIREARM

CROSS REFERENCE TO RELATED APPLICATIONS

This application claims priority to German Patent Application No. 10 2010 052 536.7 filed Nov. 25, 2010, the contents of which are incorporated herein by reference.

FIELD OF THE INVENTION

The invention pertains to a bolt for a repeating firearm.

BACKGROUND OF THE INVENTION

Repeating firearms with a fixed barrel are frequently equipped with a bolt action that is also referred to as cylinder action and features a bolt that can be moved within a bolt sleeve. The bolts that serve for closing the chamber normally feature a cylindrical bolt body that is provided with locking lugs or other locking elements and a bolt handle or bolt shaft that is arranged on the bolt body and serves for turning and displacing the bolt body. Bolt shafts of this type are usually realized integrally with the bolt body or welded, soldered or otherwise rigidly connected to the bolt body. In addition, there already exist bolts in which the bolt handle is connected to the bolt body by means of a thread. In this case, the connecting section of the bolt handle is usually provided with an external thread or the bolt handle features a continuous bore for receiving a fastening screw.

DE 31 28 369 A1 discloses a corresponding bolt for a repeating firearm with a cylindrical bolt body and a bolt shaft that is detachably fastened on the bolt body. In this bolt, an external thread of the bolt shaft is screwed into a corresponding internal thread of a threaded sleeve provided on the end of the bolt body. However, this type of fastening is not suitable for all types of bolt handles.

A lock of a handgun with an axially movable bolt and a displaceable handle is disclosed in DE 100 55 578 A1. In order to fix the handle on the bolt such that it can be selectively operated with the left or the right hand, the handle features a fork-shaped section that can be inserted into a hole on one side of the bolt or into an opposite hole on the other side of the bolt.

U.S. Pat. No. 2,085,812 A discloses a bolt in which the shaft of a bolt handle is inserted into a continuous transverse bore of the bolt and held by a transverse pin.

SUMMARY OF THE INVENTION

It is an objective of the invention to develop a bolt that can be easily manufactured and allows the use of different bolt shafts.

This objective is attained with a bolt as set forth herein. Practical additional developments and advantageous embodiments of the invention are also disclosed.

In the inventive bolt, the bolt shaft is screwed to the cylindrical bolt body by means of a fastening screw that protrudes into a sleeve-shaped rear section of the bolt body from the inner side of the bolt body through a radial through-opening and engages into a threaded bore of the bolt shaft. In this way, bolt shafts of different designs can be fastened on the bolt shaft in a relatively simple and reliable fashion and also quickly and easily exchanged, if so required. This makes it possible to significantly simplify the manufacture of bolts with bolt shafts of different designs. Since the bolt shafts are fastened from the inner side of the bolt body, the bolt shafts also do not have to feature any optically interfering and externally visible through-openings. The threaded bores provided in the bolt shafts are invisible after the assembly such that the design is improved. The bolt can be used in a flexible fashion because the universal bolt body can be fitted with different bolt shafts depending on the respective requirements.

In a particularly practical embodiment of the invention, a passage or a recess for the insertion and access of a tool is provided on the side of the sleeve-shaped rear section of the bolt body that lies diametrically opposite of the through-opening and realized, e.g., in the form of a bore. In this way, the installation of the bolt shaft can be simplified.

The through-opening provided for the fastening screw advantageously features a depression that serves as abutment for the screw head of the fastening screw on the inner wall of the sleeve-shaped rear section of the bolt body.

In one embodiment, the bolt shaft features a pin-shaped connecting region and an offset handle region. The handle region may be realized in a rod-shaped fashion and feature a pin-shaped end section for receiving a ball. However, the handle region may also have a shape that is bent like a spoon or be realized differently.

In order to adequately connect the bolt shaft to the bolt body, the through-opening features a depression that is adapted to the outside contour of the connecting region on the outer side of the sleeve-shaped section. The depression and the connecting region are advantageously realized in an oval fashion or have another noncircular outside contour. In this way, a form-fitting connection that is secured against turning can be produced between the bolt shaft and the bolt body. On its end face that points toward the outer side of the bolt body, the connecting region of the bolt shaft may also have a connecting contour that is adapted to the outside contour of the bolt body such as, e.g., an inwardly curved rounding that is adapted to the outside diameter of the bolt body. In this case, no depression is required on the outer side of the bolt body.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

As required, detailed embodiments are disclosed herein; however, it is to be understood that the disclosed embodiments are merely examples and that the systems and methods described below can be embodied in various forms. Therefore, specific structural and functional details disclosed herein are not to be interpreted as limiting, but merely as a basis for the claims and as a representative basis for teaching one skilled in the art to variously employ the present subject matter in virtually any appropriately detailed structure and function. Further, the terms and phrases used herein are not intended to be limiting, but rather, to provide an understandable description of the concepts.

The terms "a" or "an", as used herein, are defined as one or more than one. The term plurality, as used herein, is defined as two or more than two. The term another, as used herein, is defined as at least a second or more. The terms "including" and "having," as used herein, are defined as comprising (i.e., open language).

Figure 1:
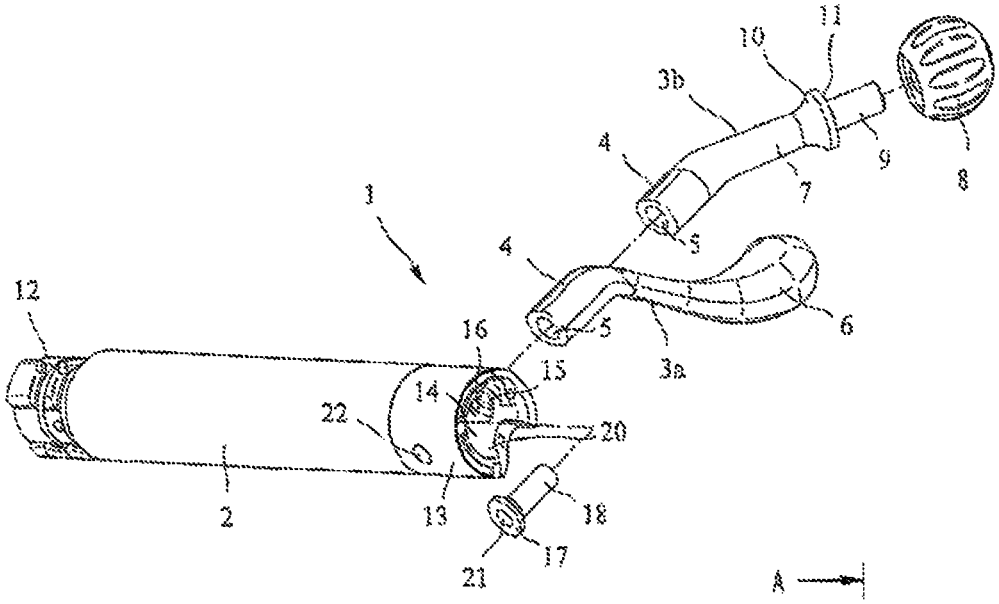
FIG. 1 shows an exploded view of a bolt with two different bolt shafts.

FIG. 1 shows a bolt 1 of a repeating firearm with a cylindrical bolt body 2 and two bolt handles or bolt shafts 3*a* and 3*b* that are detachably fastened on the bolt body 2. The two bolt shafts 3*a* and 3*b* illustrated in the form of exemplary embodiments respectively feature a pin-shaped connecting region 4 with a threaded bore 5.

The bolt shaft 3*a* is realized in one piece and features a handle region 6 that is offset relative to the connecting region 4 and has a bent shape similar to a spoon.

The bolt shaft 3*b*,in contrast, comprises two pieces and features a ball 8 on the rod-shaped handle region 7 that is also rearwardly offset relative to the connecting region 4, wherein said ball can be attached to or screwed on a pin-shaped end section 9 of the handle region 6. A conically widening stopping section 10 with a stopping face 11 for the ball 8 is provided on the handle region 6 that is realized in a rod-shaped fashion in this case.

Figure 2:
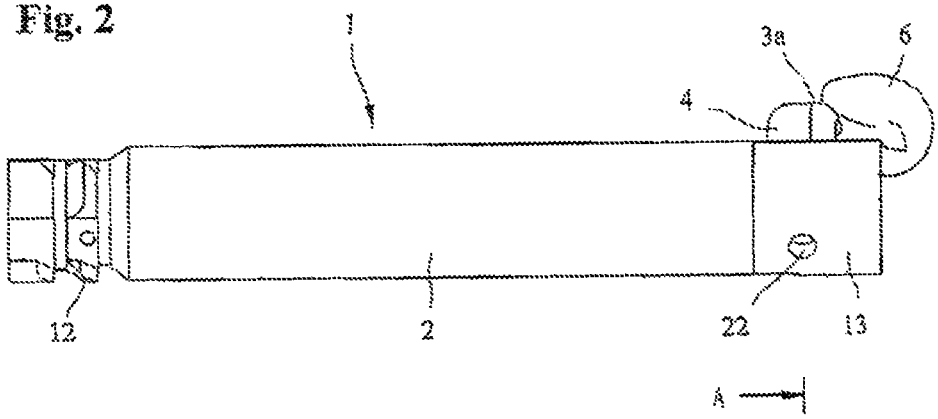
FIG. 2 shows a side view of the bolt illustrated in FIG. 1 with a bolt shaft.
Figure 3:
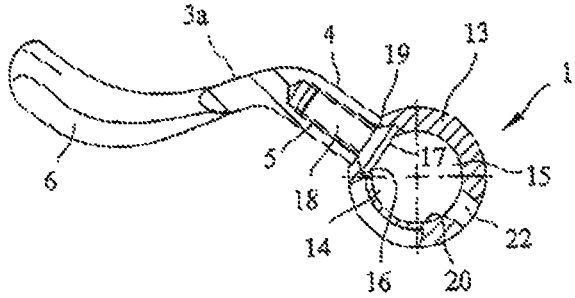
FIG. 3 shows a section along the line A-A in FIG. 2.

The bolt body 2 illustrated in FIGS. 2 and 3 also features conventional locking lugs 12 on the left front end in FIG. 2 in order to be locked in a not-shown in bolt sleeve. The right rear section 13 of the bolt body 2 in FIG. 2 is realized in a sleeve-shaped fashion and features an inner longitudinal opening 14 as shown in FIGS. 1 and 3. The through-opening 15 that extends transverse to the longitudinal axis of the bolt body 2 and features an inner indentation 16 as an abutment for a screw head 17 of a fastening screw 18 is provided on one side of the rear sleeve-shaped section 13 of the bolt body 2. The through-opening 15 according to FIG. 3 features a depression 19 that is adapted to the outside contour of the connecting region on the outer side of the sleeve-shaped section 13. The outside contour of the connecting region 4 on the bolt shaft 3*a* or 3*b* and the depression 19 on the bolt body 2 may be realized, e.g., in a oval fashion such that a form-fitting connection is produced between the bolt shaft 3*a* or 3*b* and the bolt body 2 and secured against turning. In the exemplary embodiment shown, the indentation 16 arranged on the inner wall 20 of the sleeve-shaped section 13 is realized in the form of a conical indentation for receiving a fastening screw 18 in the form of a countersunk head screw with a hexagon socket 21. Furthermore, a passage 22 in the form of a bore is provided in the sleeve-shaped section 13 of the bolt body 2 on the side that lies opposite of the transverse bore 15 in order to insert a screwdriver with a hexagon bit profile.

According to FIG. 3, the bolt shaft 3*a* can be screwed on by means of the mounting screw 18 from the inner side of the sleeve-shaped section 13 of the bolt body 2. A tool can be inserted through the passage 22 for this purpose.

All references cited herein are expressly incorporated by reference in their entirety. In addition, unless mention was made above to the contrary, it should be noted that all of the accompanying drawings are not to scale. There are many different features to the present invention and it is contemplated that these features may be used together or separately. Thus, the invention should not be limited to any particular combination of features or to a particular application of the invention. Further, it should be understood that variations and modifications within the spirit and scope of the invention might occur to those skilled in the art to which the invention pertains. Accordingly, all expedient modifications readily attainable by one versed in the art from the disclosure set forth herein that are within the scope and spirit of the present invention are to be included as further embodiments of the present invention.

What is claimed is:

1. A bolt for a repeating firearm comprising:

a cylindrical bolt body;

a bolt shaft detachably fastenable to the bolt body by a fastening screw, wherein the fastening screw protrudes into a sleeve-shaped rear section of the bolt body from an inner side of the bolt body through a radial through-opening, thereby engaging a threaded bore of the bolt shaft; and a passage for inserting a tool on a side of the sleeve-shaped rear section of the bolt body positioned diametrically opposite the through-opening.

2. The bolt according to claim 1, wherein the through-opening includes an indentation serving as an abutment for a screw head of the fastening screw on an inner wall of the sleeve-shaped rear section of the bolt body.

3. The bolt according to claim 2, wherein the indentation is formed as a conical indentation for receiving a fastening screw formed as a countersunk head with a hexagon socket.

4. The bolt according to claim 1, wherein the bolt shaft includes a pin-shaped connecting region and an offset handle region.

5. The bolt according to claim 4, wherein the offset handle region has a rod shape and includes a pin-shaped end section for receiving a ball.

6. The bolt according to claim 4, wherein the through-opening includes a depression on an outer side of the sleeve-shaped rear section adapted to an outside contour of the connecting region.

7. The bolt according to claim 4, wherein the connecting region has a noncircular outside contour.

8. The bolt according to claim 4, wherein the connecting region has a connecting contour adapted to an outside contour of the bolt body on an end face that points toward an outer side of the bolt body.

9. The bolt according to claim 8, wherein the connecting contour on the end face of the connecting region of the bolt shaft is formed as an inwardly curved rounding adapted to an outside diameter of the bolt body.

10. The bolt according to claim 1, wherein the bolt body is configured and arranged to be fitted with different bolt shafts according to use of the bolt.

11. A bolt for a repeating firearm comprising:

a cylindrical bolt body;

a bolt shaft detachably fastenable to the bolt body by a fastening screw; the fastening screw protruding into a sleeve-shaped rear section of the bolt body from an inner side of the bolt body through a radial through-opening, thereby engaging a threaded bore of the bolt shaft;

a pin-shaped connecting region; and a passage for inserting a tool on a side of the sleeve-shaped rear section of the bolt body positioned diametrically opposite the through-opening;

wherein the bolt shaft is formed as one piece having a bent shape and a handle region offset to the connecting region.

12. The bolt according to claim 11, wherein the through-opening includes a depression on an outer side of the sleeve-shaped rear section adapted to an outside contour of the connecting region.

13. The bolt according to claim 11, wherein the connecting region has a noncircular outside contour.

14. The bolt according to claim 11, wherein the connecting region has a connecting contour adapted to an outside contour of the bolt body on an end face that points toward an outer side of the bolt body.

15. The bolt according to claim 14, wherein the connecting contour on the end face of the connecting region of the bolt shaft is formed as an inwardly curved rounding adapted to an outside diameter of the bolt body.

16. A bolt for a repeating firearm comprising:

a cylindrical bolt body;

a bolt shaft detachably fastenable to the bolt body by a fastening screw; the fastening screw protruding into a sleeve-shaped rear section of the bolt body from an inner side of the bolt body through a radial through-opening, thereby engaging a threaded bore of the bolt shaft;

a pin-shaped connecting region; and a passage for inserting a tool on a side of the sleeve-shaped rear section of the bolt body positioned diametrically opposite the through-opening;

wherein the bolt shaft is formed as two pieces and includes a rod-shaped handle region offset to the connecting region and a ball attached at one end of the handle region.

* * * * *